US009139945B2

(12) United States Patent
Cha

(10) Patent No.: US 9,139,945 B2
(45) Date of Patent: Sep. 22, 2015

(54) BEARING HOUSING, WATER TUB FOR WASHING MACHINE AND MANUFACTURING MOLD UNIT THEREOF

(75) Inventor: Jeong Ho Cha, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1184 days.

(21) Appl. No.: 12/654,943

(22) Filed: Jan. 8, 2010

(65) Prior Publication Data

US 2010/0180644 A1 Jul. 22, 2010

(30) Foreign Application Priority Data

Jan. 20, 2009 (KR) ..... 10-2009-0004631

(51) Int. Cl.
*D06F 21/00* (2006.01)
*D06F 37/26* (2006.01)

(52) U.S. Cl.
CPC ..... *D06F 37/262* (2013.01); *D06F 37/264* (2013.01); *D06F 37/269* (2013.01)

(58) Field of Classification Search
CPC .... D06F 37/206; D06F 37/262; D06F 37/269
USPC ..... 68/140
See application file for complete search history.

(56) References Cited

U.S. PATENT DOCUMENTS

2004/0163428 A1* 8/2004 Kim et al. ..... 68/140
2007/0175245 A1* 8/2007 Kim et al. ..... 68/140
2009/0113941 A1* 5/2009 Kim ..... 68/140

FOREIGN PATENT DOCUMENTS

KR 10-2001-0088215 9/2001
KR 10-2007-0004508 1/2007

* cited by examiner

*Primary Examiner* — David Cormier
(74) *Attorney, Agent, or Firm* — Staas & Halsey LLP

(57) ABSTRACT

A water tub for a washing machine, manufactured by injection molding under the condition that a bearing housing to install bearings is inserted into the water tub and including support holes to allow the bearing housing to be supported by a water tub manufacturing mold unit, and the water tub manufacturing mold unit including support protrusions to support the bearing housing through the support holes. The support holes and the support protrusions prevent the bearing housing from moving in the injection molding process of the water tub, into which the bearing housing is inserted.

10 Claims, 8 Drawing Sheets

BEARING HOUSING, WATER TUB FOR WASHING MACHINE AND MANUFACTURING MOLD UNIT THEREOF

CROSS-REFERENCE TO RELATED APPLICATIONS

This application claims the benefit of Korean Patent Application No. 2009-0004631, filed on Jan. 20, 2009 in the Korean Intellectual Property Office, the disclosure of which is incorporated herein by reference.

BACKGROUND

1. Field

Embodiments of the present invention relate to a bearing housing, a water tub for a washing machine, which is formed by injection molding under the condition that the bearing housing to install bearings is inserted into the water tub, and a manufacturing mold unit of the water tub.

2. Description of the Related Art

In general, a washing machine is an apparatus that repeats courses, such as washing and rinsing courses, to wash laundry, and includes a water tub to contain water, a drum rotatably installed in the water tub, and a driving motor to generate rotary force to rotate the drum.

The driving motor includes a rotary shaft passing through the water tub to transmit rotary force to the drum, and bearings to rotatably support the rotary shaft and a bearing housing, on which the bearings are installed, provided with a shaft installation hole passing the rotary shaft are installed on the tub. Generally, the bearing housing is installed under the condition that the bearing housing is inserted into a water tub manufacturing mold unit in the injection molding process of the water tub and thus is buried under the water tub.

The above water tub manufacturing mold unit, to manufacture the water tub by injection molding under the condition that the bearing housing is inserted into the water tub, includes a first mold and a second mold, which are connected to form a cavity having a shape corresponding to the water tub therebetween. The bearing housing, which is manufactured in advance, is inserted into the cavity, and then a molten resin is injected into the cavity, thereby completing the manufacture of the water tub.

In the process of injecting the molten resin into the water tub manufacturing mold unit, the bearing housing moves due to pressure applied to the molten resin, and thus is rotated or inclined, thereby generating a defect of the water tub.

SUMMARY

Therefore, it is an aspect of the present invention to provide a bearing housing, a water tub for a washing machine and a manufacturing mold unit thereof, in which the movement of the bearing housing due to pressure applied to a molten resin is prevented.

Additional aspects of the invention will be set forth in part in the description which follows and, in part, will be apparent from the description, or may be learned by practice of the invention.

In accordance with one aspect, a water tub for a washing machine, which is manufactured by injection molding under the condition that a bearing housing to install bearings is inserted into the water tub, includes support holes to allow the bearing housing to be supported by a water tub manufacturing mold unit.

The support holes may include first support holes provided on the bearing housing to allow the water tub manufacturing mold unit to be supported by passing through the bearing housing.

The support holes may include second support holes to expose portions of the surface of the bearing housing to allow the exposed portions of the surface of the bearing housing to be supported by the water tub manufacturing mold unit.

Alternatively, the support holes may include first support holes provided on the bearing housing to allow the water tub manufacturing mold unit to be supported by passing through the bearing housing, and second support holes to expose portions of the surface of the bearing housing close to the first support holes to allow the portions of the surface of the bearing housing close to the first support holes to be supported by the water tub manufacturing mold unit.

The support holes may be provided in plural number such that the support holes are separated from each other in the circumferential direction.

In accordance with another aspect, a water tub manufacturing mold unit, which is used to manufacture a water tub for a washing machine by injection molding under the condition that a bearing housing is inserted into the water tub, includes support protrusions to support the bearing housing.

The support protrusions may include first support protrusions passing through the bearing housing to support the bearing housing.

The support protrusions may include second protrusions to support portions of the surface of the bearing housing.

Alternatively, the support protrusions may include first support protrusions passing through the bearing housing to support the bearing housing and second protrusions to support portions of the surface of the bearing housing, and the first support protrusions may be extended integrally from front ends of the second support protrusions.

The support protrusions may be provided in plural number such that the support protrusions are separated from each other in the circumferential direction.

The water tub manufacturing mold unit may further include a first mold forming the outer surface of the water tub and provided with the support protrusions, and a second mold forming the inner surface of the water tub.

In accordance with a further aspect, a bearing housing includes first support holes supported by a water tub manufacturing mold unit used to manufacture a water tub for a washing machine, wherein portions of the surface of the bearing housing close to the first support holes are exposed to the outside through second support holes provided on the water tub, and are supported by the water tub manufacturing mold unit

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
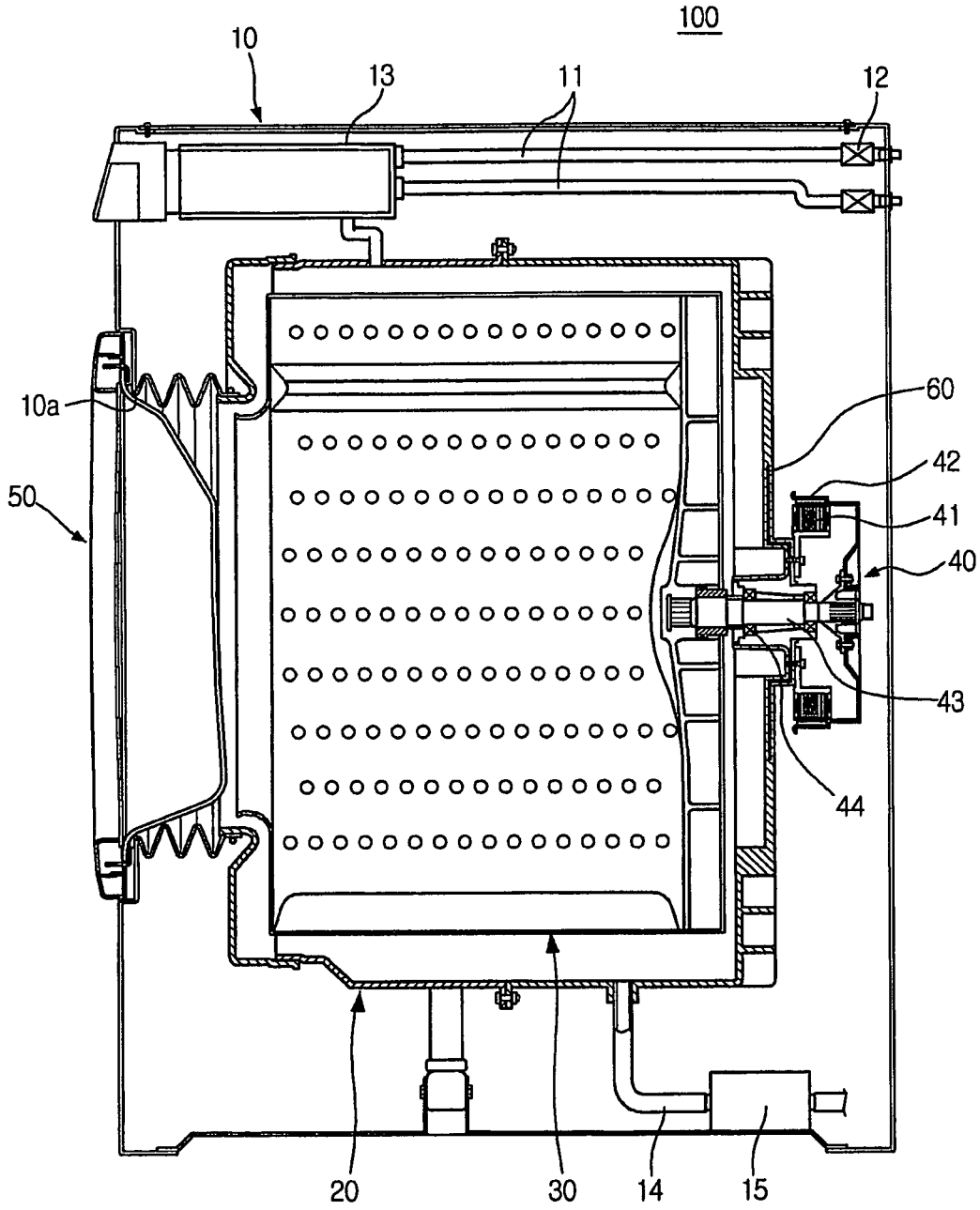
FIG. 1 is a longitudinal-sectional view of a washing machine in accordance with one embodiment.

Reference will now be made in detail to the embodiments of the present invention, examples of which are illustrated in the accompanying drawings, wherein like reference numerals refer to like elements throughout.

Hereinafter, a washing machine in accordance with one embodiment will be described with reference to the accompanying drawings.

In this embodiment, a drum washing machine, which washes laundry using a head, will be exemplarily described.

As shown in FIG. 1, a washing machine 100 in accordance with this embodiment includes a housing 10 forming the external appearance of the washing machine 100, a water tub 20 installed in the housing 10 in a suspension manner to contain water, a drum 30 rotatably installed in the water tub 20 such that laundry is put into the drum 30, and a driving motor 40 installed on the rear surface of the water tub 20 to generate rotary force to rotate the drum 30. As the drum 30 is rotated by the driving motor 40, the laundry in the drum 30 is raised and dropped, and thus is washed by the head.

Water supply pipes 11 to supply water to the water tub 20, water supply valves 12 to open and close the water supply pipes 11, and a detergent supply device 13 to mix a detergent with water supplied through the water supply pipes 11 are disposed above the tub 20. Further, a drain pipe 14 to guide washing water in the tub 20 to the outside of the housing 10 after the washing of the laundry has been completed and a drain pump 15 to discharge the washing water to the outside of the housing 10 through the drain pipe 14 are disposed below the water tub 20.

An opening 10*a*, through which the laundry is put into and taken out of the housing 10, is formed through the housing 10 by opening a portion of the front surface of the housing 10, and a door 50 to open and close the opening 10*a* is installed at the opening 10*a*.

The driving motor 40 includes a stator 41 fixed to the rear surface of the water tub 20, a rotor 42 installed at the outside of the stator 41 and rotated by interaction with the stator 41, and a rotary shaft 43 provided with one end fixed to the rotor 42 and the other end passing through the water tub 20 and fixed to the drum 30.

Figure 2:
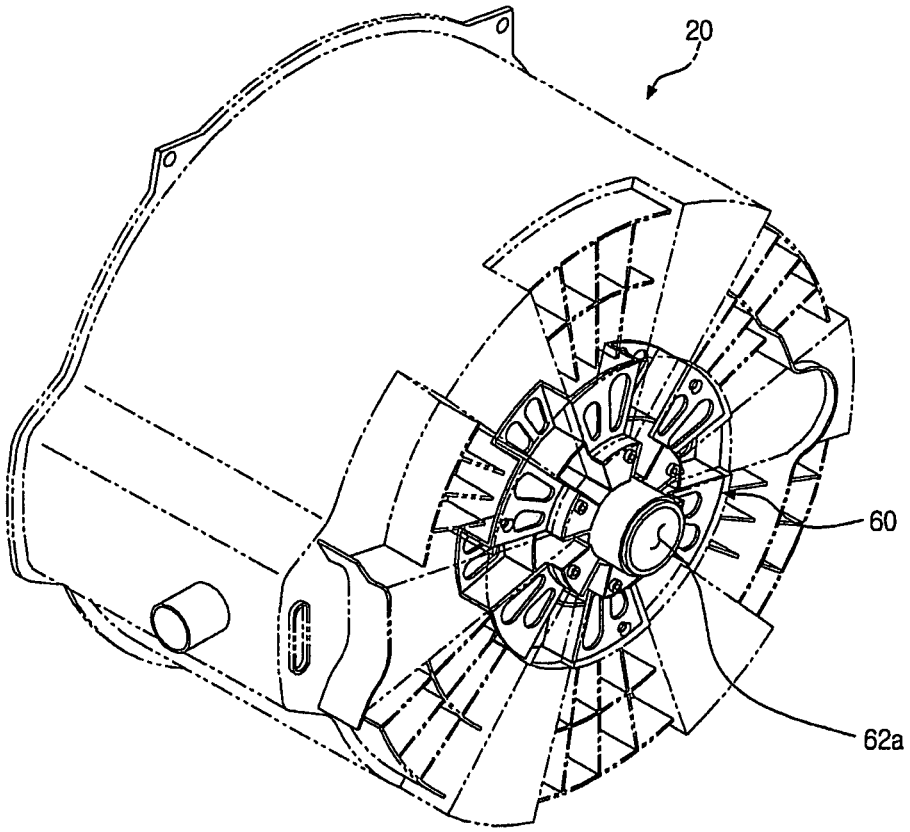
FIG. 2 is a perspective view illustrating the installation state of a bearing housing applied to the washing machine in accordance with the embodiment.

In order to rotatably install the rotary shaft 43 passing through the water tub 20, a pair of bearings 44 to rotatably support the rotary shaft 43 and a bearing housing 60, on which the bearings 44 are installed, made of a metal having a higher strength than that of the water tub 20 made of resin are installed on the water tub 20. The bearing housing 60 is installed under the condition that the bearing housing 60 is inserted into the injection molding process of the tub 20 and thus is buried under the tub 20, as shown in FIG. 2.

Figure 3:
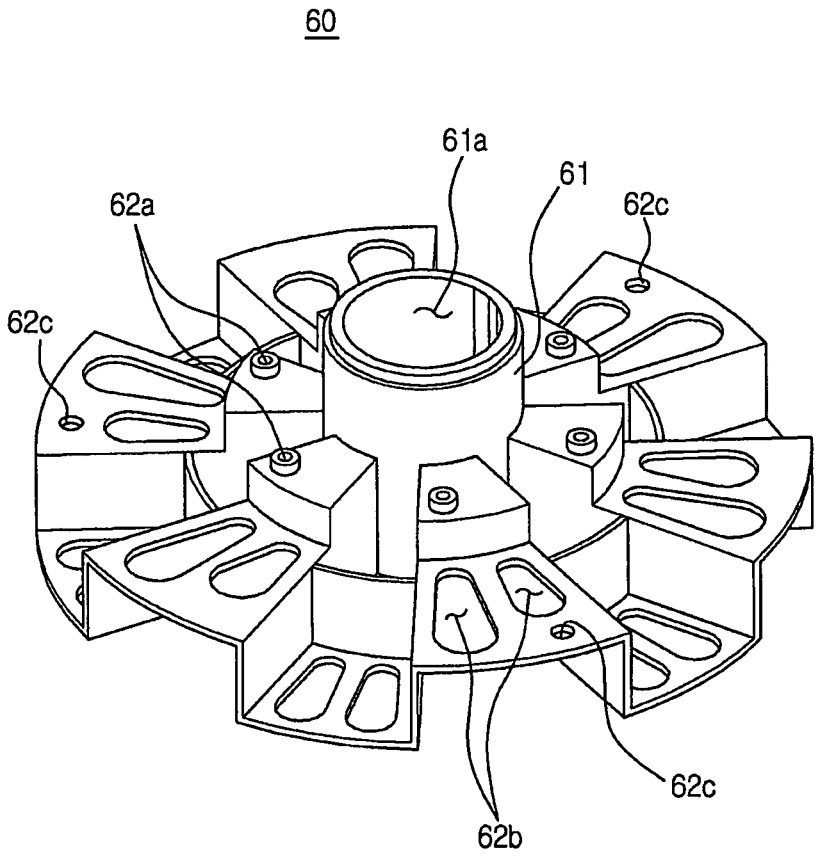
FIG. 3 is a perspective view of the bearing housing applied to the washing machine in accordance with the embodiment.

The bearing housing 60, as shown in FIG. 3, includes a hub part 61 provided with a shaft installation hole 61*a* at the center thereof to install the rotary shaft 43, and a flange part 62 extended from the hub part 61 to the outside of the radial direction to stably maintain the fixed state of the bearing housing 60 to the rear surface of the water tub 20. Bearing installation parts 61*b* (with reference to FIG. 7) having a larger diameter than that of the shaft installation hole 61*a* to install the bearings 44 are respectively provided at both ends of the shaft installation hole 61*a*, thus allowing one pair of the bearings 44 to be installed in the shaft installation hole 61*a*. Connection parts 62*a*, to which the stator 41 of the driving motor 40 are connected through screws, are provided at portions of the flange part 62 of the bearing housing 60 close to the hub part 61, and a plurality of fixation holes 62*b* to pass a molten resin to maintain the stably fixed state of the bearing housing 60 to the rear surface of water tub 20 is formed through the flange part 62.

Further, a plurality of support holes 62*c* and 20*a* to prevent the movement of the bearing housing 60 in the injection molding process of the water tub 20, into which the bearing housing 60 is inserted, is formed through the water tub 20, and the water tub 20 is supported by a water tub manufacturing mold unit 70 (with reference to FIG. 4) through the support holes 62*c* and 20*a*.

Figure 5:
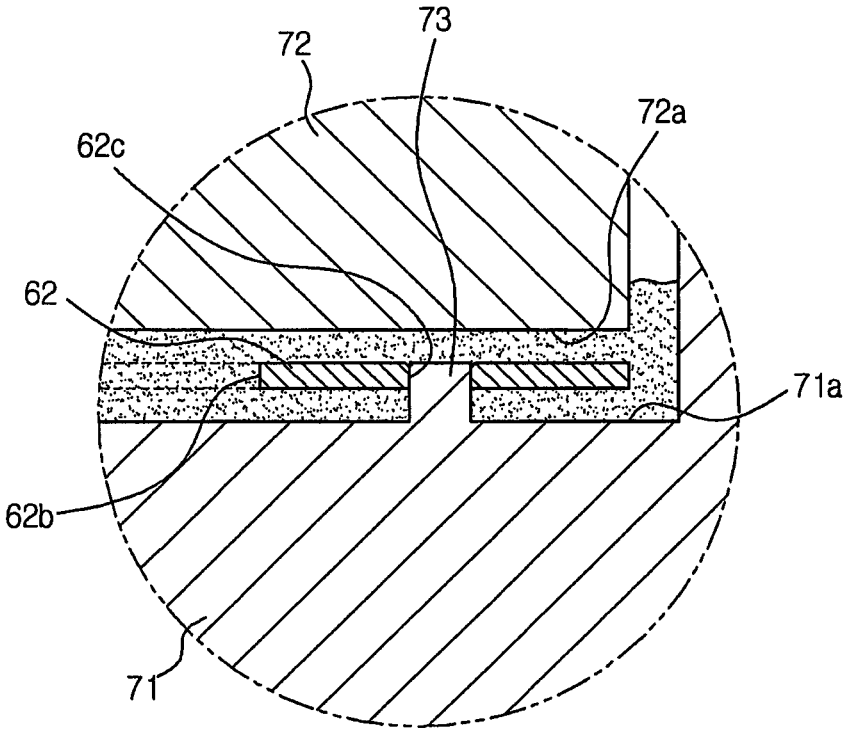
FIG. 5 is an enlarged view of the portion V of FIG. 4.
Figure 6:
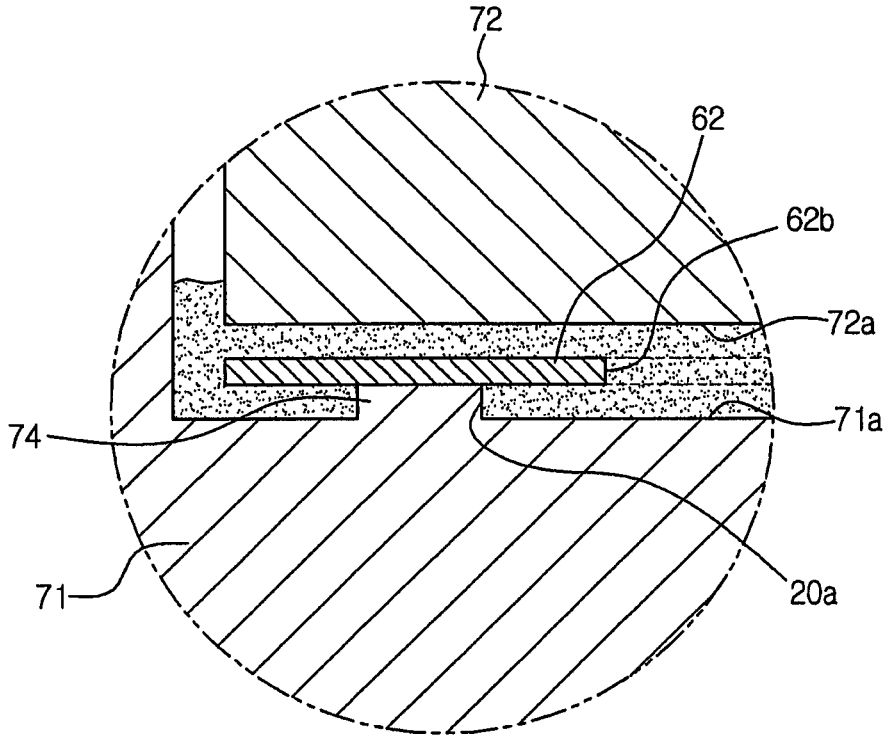
FIG. 6 is an enlarged view of the portion VI of FIG. 4.

In this embodiment, the plural support holes 62*c* and 20*a* include first support holes 62*c* provided on the bearing housing 60 to allow the water tub manufacturing mold unit 70 to be installed through the bearing housing 60, as shown in FIG. 5, and second support holes 20*a* exposing the surface of the bearing housing 60 to allow the bearing housing 60 to be supported by the water tub manufacturing mold unit 70 through the exposed surface, as shown in FIG. 6.

In this embodiment, the first support holes 62*c* and the second support holes 20*a* are separately provided, and are separated from each other at the flange part 62 of the bearing housing 60 in the circumferential direction. Therefore, the first support holes 62*c* prevent the rotation of the bearing housing 60 in the injection molding process of the water tub 20, and the second support holes 20*a* prevent the inclination of the bearing housing 60 in the injection molding process of the water tub 20, thus preventing a defect of the water tub 20 from being generated when the bearing housing 60 is rotated or inclined.

Figure 4:
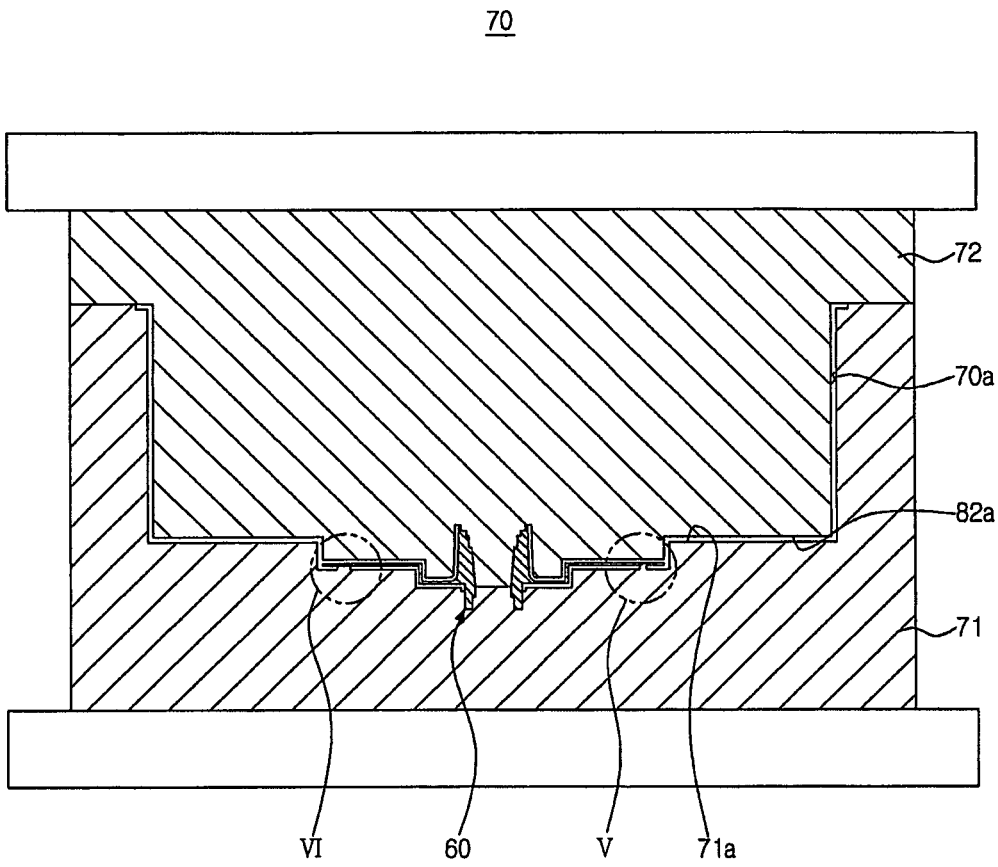
FIG. 4 is a perspective view illustrating a manufacturing mold unit of a water tub for the washing machine in accordance with the embodiment.

As shown in FIG. 4, the water tub manufacturing mold unit 70, which is used to manufacture the water tub 20 for the washing machine, includes a first mold 71 and a second mold 72, which are connected to form a cavity 70*a* having a shape corresponding to the water tub 70 therebetween. The first mold 71 includes a first mold plane 71*a* formed in a shape corresponding to the outer surface of the water tub 20, and the second mold 72 includes a second mold plane 72*a* formed in a shape corresponding to the inner surface of the water tub 20. The cavity 70*a* is formed between the first mold plane 71*a* and the second mold plane 72*a*.

The water tub manufacturing mold unit 70 further includes support protrusions 73 and 74, which are inserted into the support holes 62*c* and the 20*a* formed on the bearing housing 60 to prevent the movement of the bearing housing 60, as shown in FIGS. 5 and 6.

The support protrusions 73 and 74 include first support protrusions 73 inserted into the first support holes 62*c* provided on the bearing housing 60 to support the inner surfaces of the first support holes 62*c*, as shown in FIG. 5, and second support protrusions 74 supported by the surface of the bearing housing 60 to form the second support holes 20*a* on the water tub 20, as shown in FIG. 6. Since the support holes 62*c* and 20*a* include the plural first support holes 62*c* and the plural second support holes 20*a* formed on the bearing housing 60 and separated from each other in the circumferential direction, as described above, the plural first support protrusions 73 and the plural second support protrusions 74 corresponding to the first support holes 62*c* and the second support holes 20*a* are separated from each other in the circumferential direction.

Therefore, the first support protrusions 73 are supported by the inner surfaces of the first support holes 62*c* and thus prevent the rotation of the bearing housing 60 in the injection molding process of the water tub 20, and the surface of the bearing housing 60 is supported by the second support protrusions 74 and thus prevent the inclination of the bearing housing 60 in the injection molding process of the water tub 20.

Figure 7:
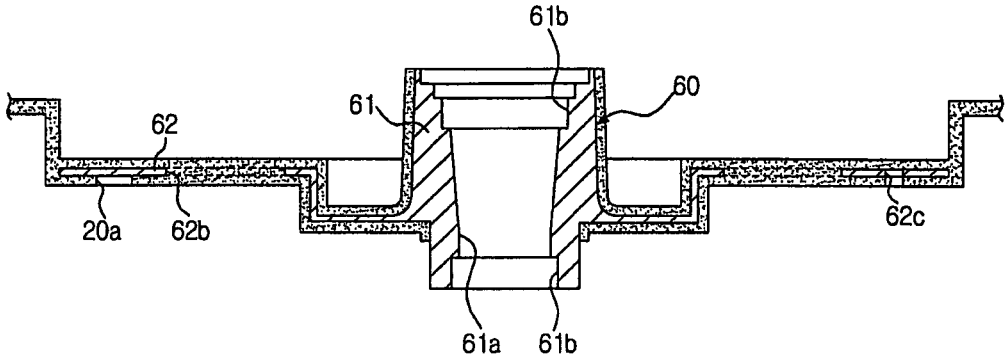
FIG. 7 is a partial sectional view of the water tub manufactured from the manufacturing mold unit of the water tub for the washing machine in accordance with the embodiment.

Further, when the water tub 20 is manufactured from the above water tub manufacturing mold unit 70, the second support holes 20*a* are formed on the bearing housing 60 by the second support protrusions 74, and thus some portions of the bearing housing 60 are exposed to the outside of the water tub 20 through the second support holes 20*a*, as shown in FIG. 7. If the plural support holes 62*c* and 20*a* on the water tub 20 are separated from each other in the circumferential direction, whether or not the thickness of the rear portion of the bearing housing 60 is uniform is checked through the support holes 62*c* and 20*a*, and thus whether or not the manufactured water tub 20 is defective is easily determined.

In this embodiment, the support protrusions 73 and 74 are formed on the first mold 71 forming the outer surface of the water tub 20. If the support protrusions 73 and 74 are formed on the second mold 72 forming the inner surface of the water tub 20, water filling the water tub 20 contacts the bearing housing 60 through the first support holes 62*c* and the second support holes 20*a*, and may corrode the bearing housing 60. Therefore, the support protrusions 73 and 74 formed on the first mold 71 prevent the corrosion of the bearing housing 60.

Figure 8:
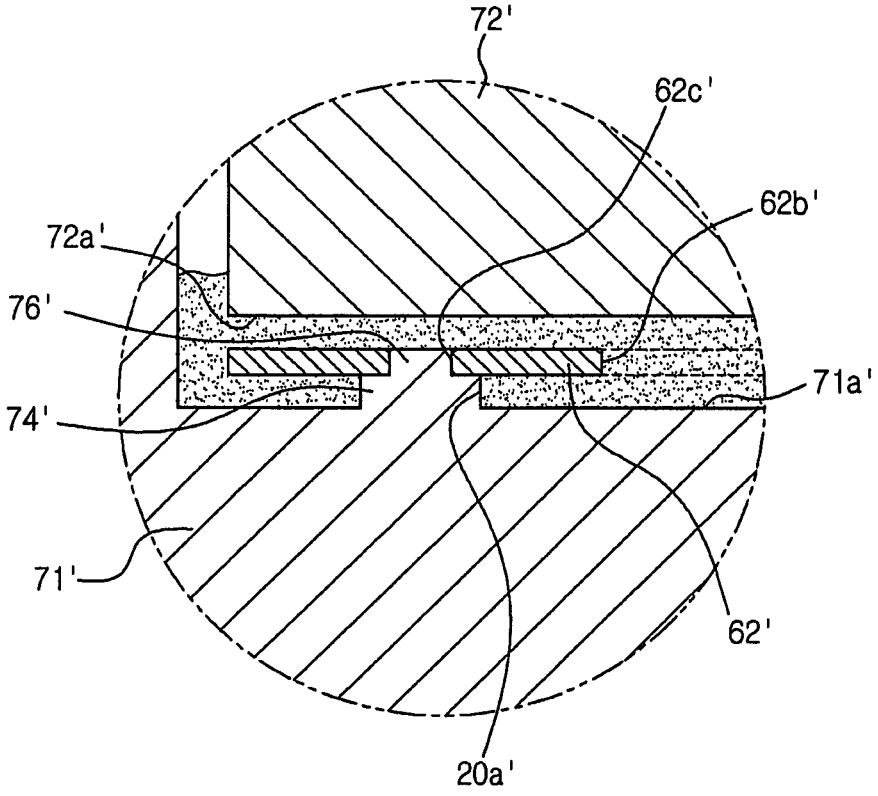
FIG. 8 is a sectional view illustrating a support hole provided on a water tub for a washing machine and a support protrusion provided on a manufacturing mold unit of the water tub in accordance with another embodiment.

Although this embodiment describes that the first support holes 62*c* and the second support holes 20*a* are separated from each other in the circumferential direction and the first support protrusions 73 and the second support protrusions 74 corresponding to the first and second support holes 62*c* and 20*a* are separated from each other in the circumferential direction, the first and second support holes 62*c* and 20*a* and the first and second support protrusions 73 and 74 are not limited thereto. That is, in accordance with another embodiment of the present invention, as shown in FIG. 8, first support holes 62*c*' and second support holes 20*a*' are formed at the same positions of the water tub 20 in parallel, and thus portions of the surface of the bearing housing 60' around the first support holes 62*c*' are exposed to the outside of the water tub 20 through the second support holes 20*a*'. Here, in order to form the first support holes 62*c*' and the second support holes 20*a* in parallel, first support protrusions 73' to support the inner surfaces of the first support holes 62*c*' are extended integrally from front ends of second support protrusions 74' of a water tub manufacturing mold unit 70' to support the surface of the bearing housing 60', and thus the second support protrusions 74' support the portions of the surface of the bearing housing 60' around the first support holes 62*c*'.

As is apparent from the above description, in the water tub for the washing machine and the manufacturing mold unit thereof in accordance with one embodiment of the present invention, the support protrusions provided on the mold unit are inserted into the support holes provided on the water tub, and thus the movement of the bearing housing generated in the injection molding process of the water tub under the condition that the bearing housing is inserted into the water tub is prevented.

Further, the support protrusions include the first support protrusions supported by portions of the bearing housing close to the support holes and the second support protrusions inserted into the support holes to support the inner surfaces of the support holes, and thus prevent both the rotation and the inclination of the bearing housing.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A water tub for a washing machine system, comprising:

a water tub manufacturing mold unit;

a water tub manufactured by injection molding using the water tub manufacturing mold unit;

a bearing housing to install bearings inserted into the water tub, the bearing housing including a hub part provided with a shaft installation hole and a flange part extended from the hub part; and a plurality of fixation holes formed on the bearing housing to pass a molten resin to maintain a stably fixed state of the bearing housing;

wherein the bearing housing includes support holes and the water tub manufacturing mold unit includes support protrusions, the support holes and support protrusions being configured to allow the bearing housing to be supported by the water tub manufacturing mold unit, wherein the flange part include: at least one first surface, and at least one second surface disposed rearward of the first surface in axial direction of the bearing housing, and wherein the first surface include: a connecting part configured to connect with a driving motor, and the second surface includes at least one of the fixation holes and the support holes.

2. The system according to claim 1, wherein the support holes include first support holes provided on the bearing housing to allow the water tub manufacturing mold unit to be supported by passing through the bearing housing.

3. The system according to claim 1, wherein second support holes, which are provided in the water tub, to expose portions of the surface of the bearing housing to allow the exposed portions of the surface of the bearing housing to be supported by the water tub manufacturing mold unit.

4. The system according to claim 1, wherein the support holes include first support holes provided on the bearing housing to allow the water tub manufacturing mold unit to be supported by passing through the bearing, and wherein second support holes, which are provided in the water tub, to expose portions of the surface of the bearing housing close to the first support holes to allow the exposed portions of the surface of the bearing housing close to the first support holes to be supported by the water tub manufacturing mold unit.

5. The system according to claim 1, wherein the support holes are provided in plural number such that the support holes are separated from each other in a circumferential direction of the bearing housing.

6. The system according to claim 1, wherein the bearing housing comprises a plurality of surfaces, and the support holes and the fixation holes are provided on at least one same surface of the plurality of surfaces.

7. The system according to claim 1, wherein the bearing housing comprises a plurality of surfaces, and the fixation holes are provided in a plurality thereof, provided on at least one same surface of the plurality of surfaces.

8. The system according to claim 1, wherein the support holes are provided in three units thereof.

9. The system according to claim 1, wherein the support holes are provided in at least three units thereof.

10. The system according to claim 1, wherein a cross sectional area of the fixation holes are larger than a cross sectional area of the support holes.

* * * * *